US008771107B1

(12) United States Patent
Ayala

(10) Patent No.: US 8,771,107 B1
(45) Date of Patent: Jul. 8, 2014

(54) BASEBALL PITCHING TRAINING APPARATUS

(76) Inventor: Isaac S. Ayala, Leona Valley, CA (US)

( * ) Notice: Subject to any disclaimer, the term of this patent is extended or adjusted under 35 U.S.C. 154(b) by 226 days.

(21) Appl. No.: 13/230,886

(22) Filed: Sep. 13, 2011

(51) Int. Cl.
*A63B 69/00* (2006.01)

(52) U.S. Cl.
CPC ..... *A63B 69/0002* (2013.01); *A63B 2069/0004* (2013.01); *A63B 2069/0006* (2013.01)
USPC ..... 473/456; 473/422; 473/454

(58) Field of Classification Search
CPC ..... A63B 2069/0006; A63B 2069/0004; A63B 69/0002; A63B 69/00; A63B 2243/0004
USPC ..... 473/454–456, 422, 434, 451; 273/348, 273/407, 402
See application file for complete search history.

(56) References Cited

U.S. PATENT DOCUMENTS

| | | | | | |
|---|---|---|---|---|---|
| 1,142,184 | A | * | 6/1915 | Lawrence | 473/454 |
| 1,652,062 | A | | 12/1927 | Stauffer | |
| 3,312,467 | A | * | 4/1967 | Dawson | 473/454 |
| 4,210,326 | A | * | 7/1980 | Booth et al. | 473/454 |
| 4,254,952 | A | * | 3/1981 | Playter, Jr. | 473/456 |
| 4,473,227 | A | | 9/1984 | Klaus | |
| 4,489,941 | A | * | 12/1984 | Shieh | 473/197 |
| 4,629,188 | A | * | 12/1986 | Mahieu | 473/454 |
| 4,643,423 | A | * | 2/1987 | Wright | 473/456 |
| 4,657,250 | A | * | 4/1987 | Newland et al. | 473/432 |
| 4,930,774 | A | | 6/1990 | Butcher | |
| 5,046,729 | A | | 9/1991 | Yancey | |
| 5,083,774 | A | | 1/1992 | Yalvac | |
| 5,222,731 | A | * | 6/1993 | Hanabusa et al. | 473/436 |
| 5,439,211 | A | | 8/1995 | Drabowsky | |
| 5,516,115 | A | * | 5/1996 | McLain | 473/417 |
| 5,527,032 | A | * | 6/1996 | Coleman et al. | 473/439 |
| 5,573,240 | A | * | 11/1996 | Humboldt | 473/454 |
| 6,093,120 | A | | 7/2000 | Luke, Jr. | |
| 6,189,889 | B1 | * | 2/2001 | Yip | 473/460 |
| 6,551,205 | B1 | * | 4/2003 | Koelzer et al. | 473/454 |
| 6,846,253 | B1 | * | 1/2005 | Szwalek | 473/446 |
| 7,662,053 | B1 | * | 2/2010 | Summers et al. | 473/431 |
| 7,762,912 | B2 | * | 7/2010 | Lewis | 473/454 |
| 8,001,838 | B2 | * | 8/2011 | Roberts | 473/455 |
| 2002/0151387 | A1 | * | 10/2002 | Henson | 473/446 |
| 2004/0127308 | A1 | | 7/2004 | Swanson | |
| 2006/0033282 | A1 | | 2/2006 | Fenwick | |

* cited by examiner

*Primary Examiner* — Mitra Aryanpour
(74) *Attorney, Agent, or Firm* — Robert C. Montgomery; Montgomery Patent & Design

(57) ABSTRACT

A baseball pitching training apparatus is for practicing accuracy and consistency in throwing a baseball or softball. The apparatus has a durable target with a plurality of target zone openings and a plurality of mesh pockets, with one pocket attached to a rear side of the target behind a target zone opening. In use, the user aims a baseball at a selected target zone in order to train pitching situation accuracy and consistency. The target also includes a plurality of apertures along top and bottom edges to facilitate suspension from a structure. The bottom edge of the target can alternately have a sleeve for supporting a weighted insert to maintain the position and shape of the target in a substantially vertical plane when suspended from support structure.

13 Claims, 6 Drawing Sheets

BASEBALL PITCHING TRAINING APPARATUS

RELATED APPLICATIONS

The present invention was first described in a notarized Official Record of Invention on Sep. 22, 2010, that is on file at the offices of Montgomery Patent and Design, LLC, the entire disclosures of which are incorporated herein by reference.

FIELD OF THE INVENTION

The present invention relates generally to baseball training apparatus, and in particular, to an apparatus for training of pitching a baseball.

BACKGROUND OF THE INVENTION

Baseball and softball have remained popular sports throughout recent history. The pure exhilaration of playing a classic game with your teammates is something that many people cannot resist. However, for one to become skilled at baseball or softball takes a great deal of time and practice, especially when it comes to pitching the ball. More games are won and lost on pitching than almost any other factor of the game. Accordingly much teaching and coaching time is spent on pitching; much to the chagrin of the pitchers, as pitching practice is typically very tedious and boring.

One (1) way to improve pitching skills is to evaluate the accuracy and consistency of a pitched ball. Having a coach or other training staff available is one (1) method of observing this skill; however, having dedicated training personnel is not feasible for most players. This is particularly a problem for the young or beginning athlete who is trying to hone their pitching skills in the off-season away from athletic coaches. This need has led to the development of personal training apparatus suitable for practicing and assessing the skills required for being a successful pitcher.

While these training apparatus may achieve their intended purpose and objectives, each suffers from at least one (1) disadvantage or deficiency related to design or utilization. Particularly, these apparatus lack specifically designated target zones for a pitcher to aim based on in-game situations. Additionally, these apparatus lack the ability to retain a large number of balls neatly for retrieval at the commencement of a training session. Another disadvantage of these apparatus is that they do not provide a support frame that is simple and easy to assemble, disassemble, and transport to a training location, such as an empty ball field or a batting cage. Another disadvantage of these apparatus is the use of complicated sensors and color schemes that can lead to confusion during training and are prone to failure. Another disadvantage of these apparatus is the requirement of a support stand for use. Additionally, these apparatus often have rigid target zones which limit usage of the apparatus to those having a certain skill level. According, none of these training apparatus have adequately addressed these disadvantages.

SUMMARY OF THE INVENTION

The inventor has therefore recognized the aforementioned inherent problems and lack in the art and observed that there is a need for an apparatus in which pitching practice can be performed and skills be improved and a method of use thereof. In accordance with the invention, it is an object of the present embodiments to solve at least one of these problems.

The inventor recognized these problems and has addressed this need by developing a training aid for baseball pitching that provides a means for pitchers of any age, from little league to professionals, to improve their pitching in a manner which is easy, entertaining, and effective. The inventor has thus realized the advantages and benefits of providing a resilient flexible target having a plurality of target zone openings disposed through a front surface corresponding to a plurality of locations of a pitched ball, a plurality of upper apertures along an upper edge, a plurality of lower apertures along a lower edge, and a plurality of mesh pockets affixed to a rear surface of the target aligned with each of the plurality of target zone openings for retaining the pitched ball after passing through any one (1) of the plurality of target zone openings. A rectangular frame is provided for supporting the target in a substantially vertical plane. A first elastic cord having end hooks disposed on opposing ends is provided and is attachable around an upper portion of the frame, such that the first elastic cord end hooks connect to an opposing pair of the plurality of target upper apertures. A second elastic cord having end hooks disposed on opposing ends is also provided and is attachable around a lower portion of the frame such that the second elastic cord end hooks connect to an opposing pair of the plurality of target lower apertures.

In an embodiment of the invention, the plurality of target zone openings include at least a center zone corresponding to a strike zone, a right zone corresponding to a right outside of said strike zone, a left zone corresponding to a left outside of said strike zone, an upper zone corresponding to an upper outside of said strike zone, and a lower zone corresponding to a lower outside of said strike zone.

In an embodiment of the invention, the resilient flexible target includes a plurality of target zone openings disposed through a front surface corresponding to a plurality of locations of a pitched ball, a plurality of mesh pockets affixed to a rear surface aligned with each of the plurality of target zone openings for retaining the pitched ball after passing through any one (1) of the plurality of target zone openings, a plurality of upper apertures disposed along an upper edge for suspending the target from a support structure, a weighted lower edge for providing a downward tension upon the target for biasing the target in a substantially vertical plane. An elastic cord having end hooks disposed on opposing ends is provided for attaching an upper end of the target to the support structure. The elastic cord insertingly attaches through the plurality of target upper apertures and the end hooks connect to the support structure.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | baseball pitching training apparatus |
| 11 | batters box |
| 12 | ball |
| 20 | frame |
| 21 | U-shaped member |
| 22 | guide |
| 23 | vertical member |
| 24 | vertical member aperture |
| 25 | lower member |
| 26 | T-portion |
| 27 | T-portion upper aperture |
| 28 | T-portion side aperture |
| 29 | horizontal member |
| 30 | target |
| 31 | front target surface |
| 32 | rear target surface |
| 33 | target upper aperture |
| 34 | target lower aperture |
| 35 | center zone |
| 36 | left zone |
| 37 | right zone |
| 38 | upper zone |
| 39 | lower zone |
| 40 | mesh pocket |
| 41 | entrance strip |
| 42 | opening |
| 45 | elastic cord |
| 46 | end hook |
| 50 | alternate target |
| 51 | sleeve |
| 52 | weighted rod |

DETAILED DESCRIPTION OF THE PREFERRED EMBODIMENT

Figure 4:
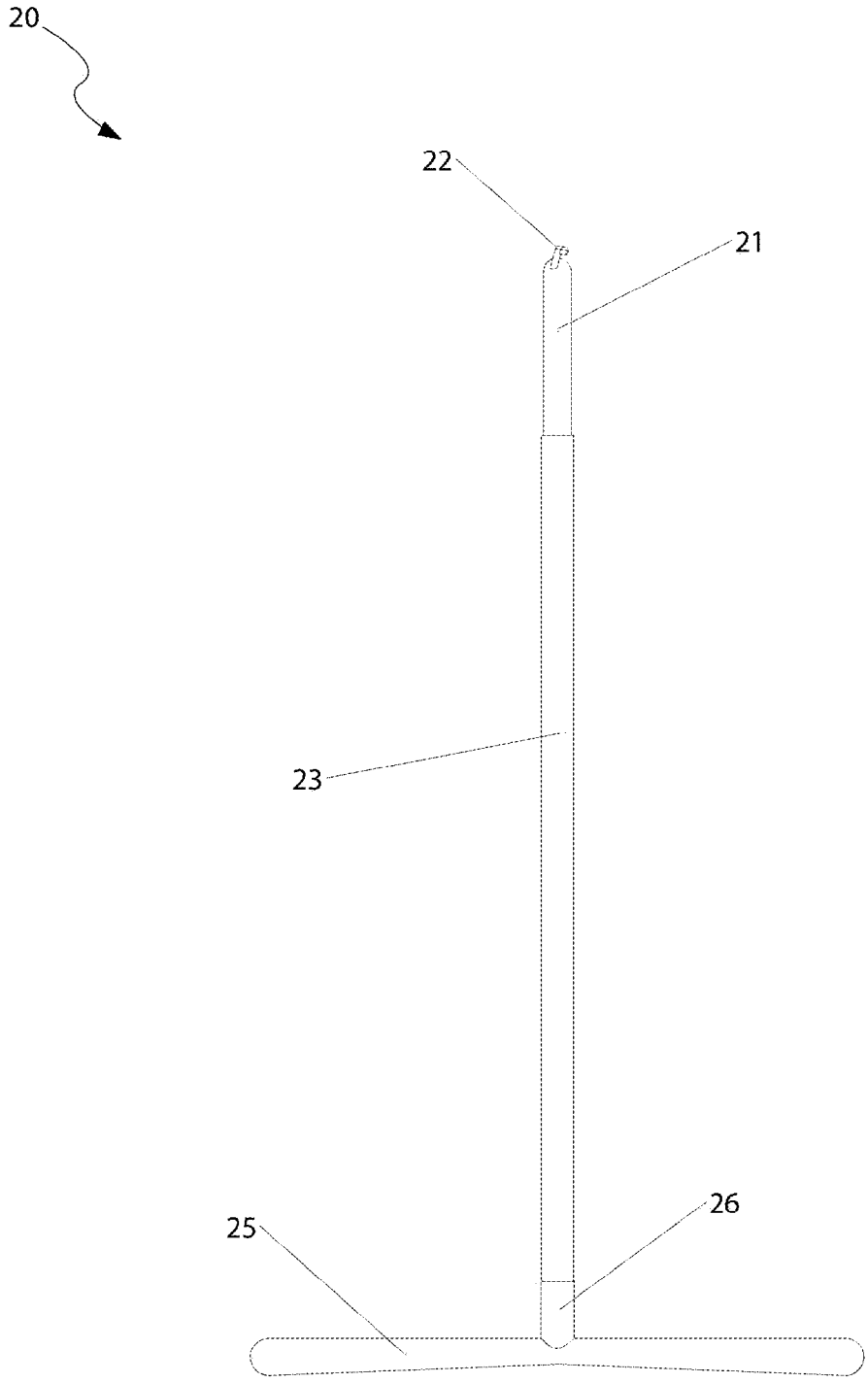
FIG. 4 is a side view of the frame, according to the preferred embodiment.
Figure 5:
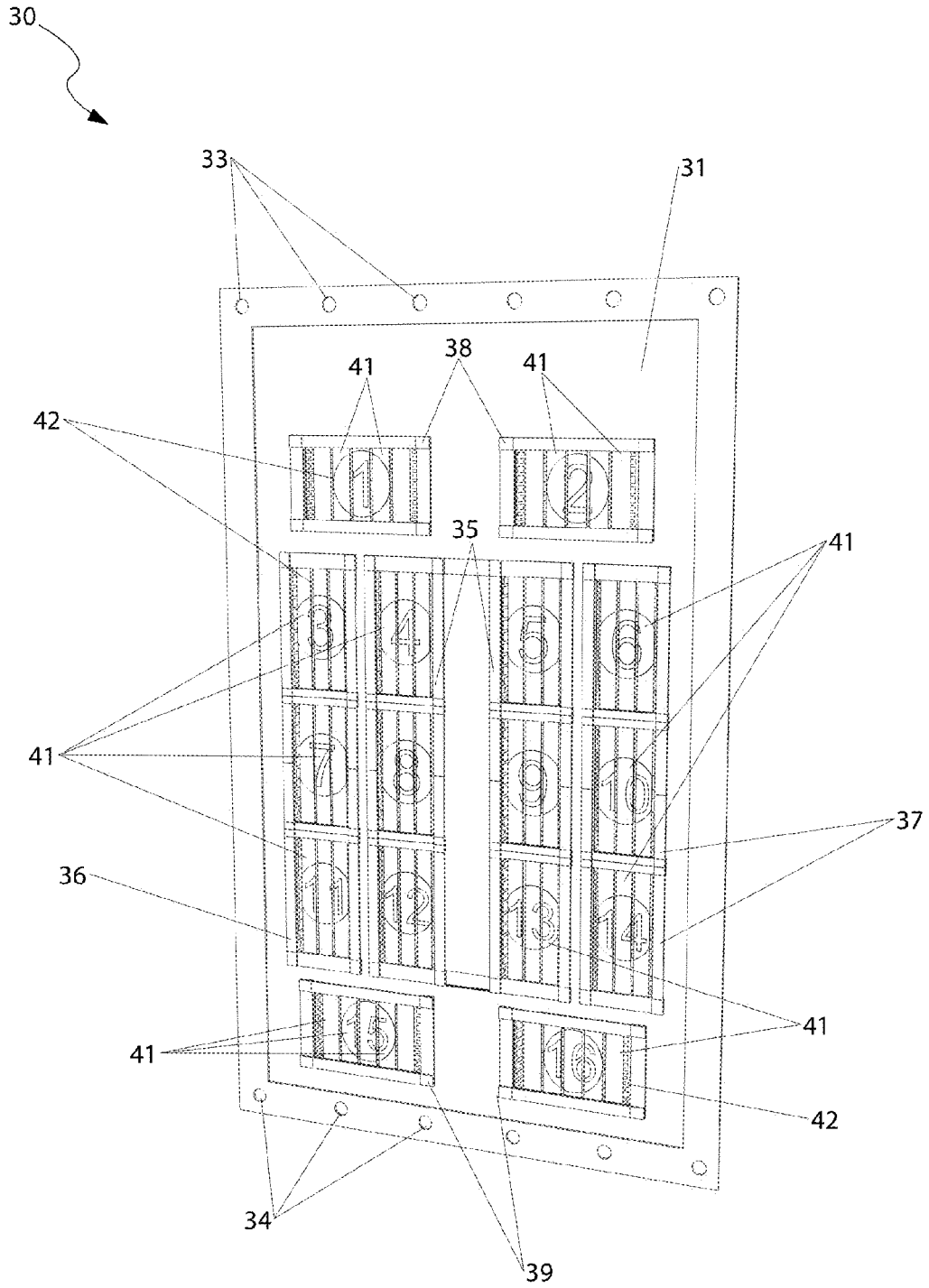
FIG. 5 is a perspective view of a target, according to the preferred embodiment; and, FIG. 6 is a perspective view of an alternate target, according to an alternate embodiment in accordance with the invention.
Figure 6:
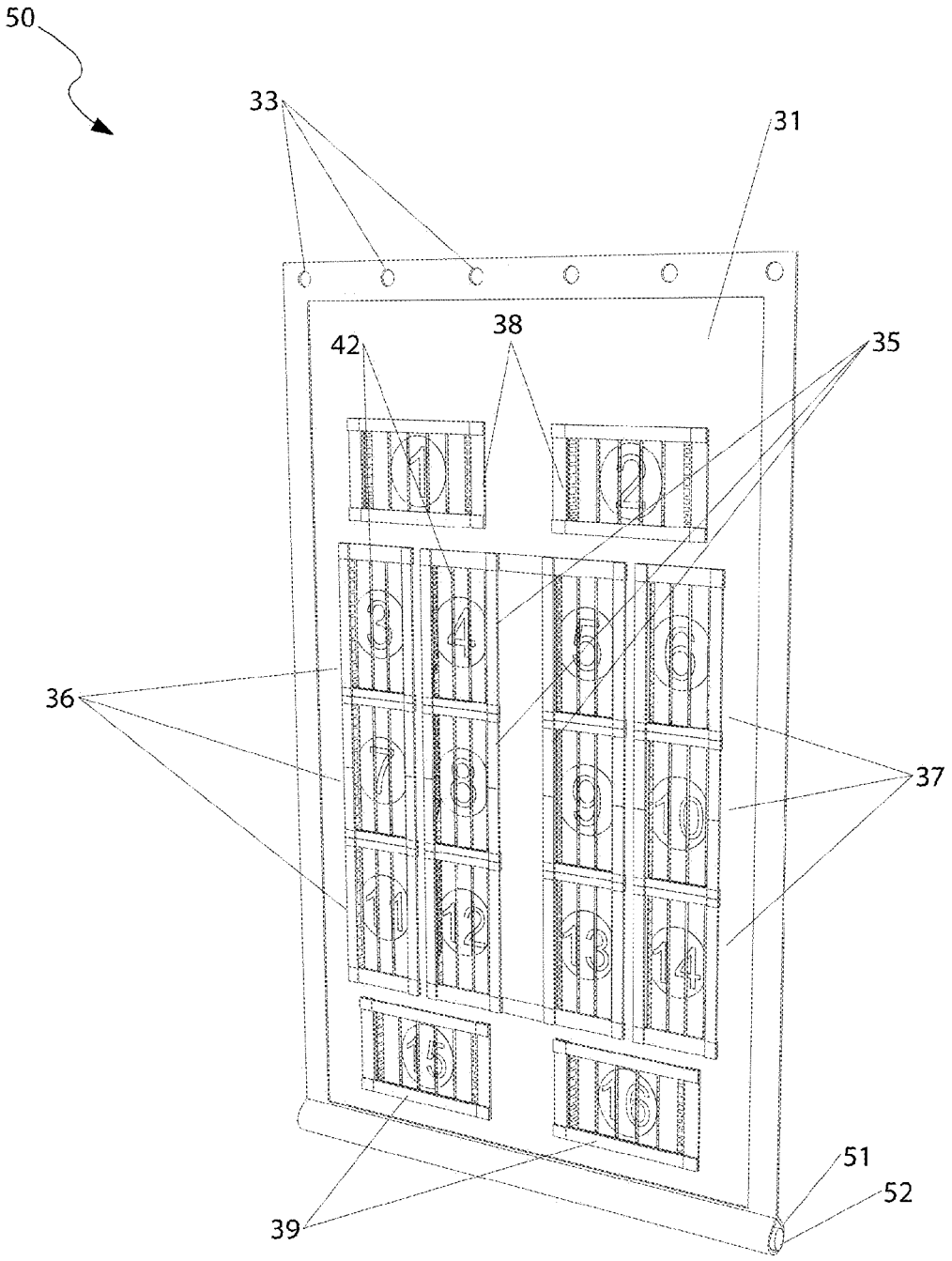

In accordance with the invention, the best mode is presented in terms of a preferred embodiment, herein depicted within FIGS. 1 through 5, and in terms of an alternate embodiment, herein depicted within FIG. 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 6, depicting a baseball pitching training apparatus (herein described as the "apparatus") 10, where like reference numerals represent similar or like parts. In accordance with the invention, the present disclosure describes an apparatus 10 that provides a means for a baseball pitcher to practice and improve pitching skills by practicing control and situational pitching scenarios.

Figure 1:
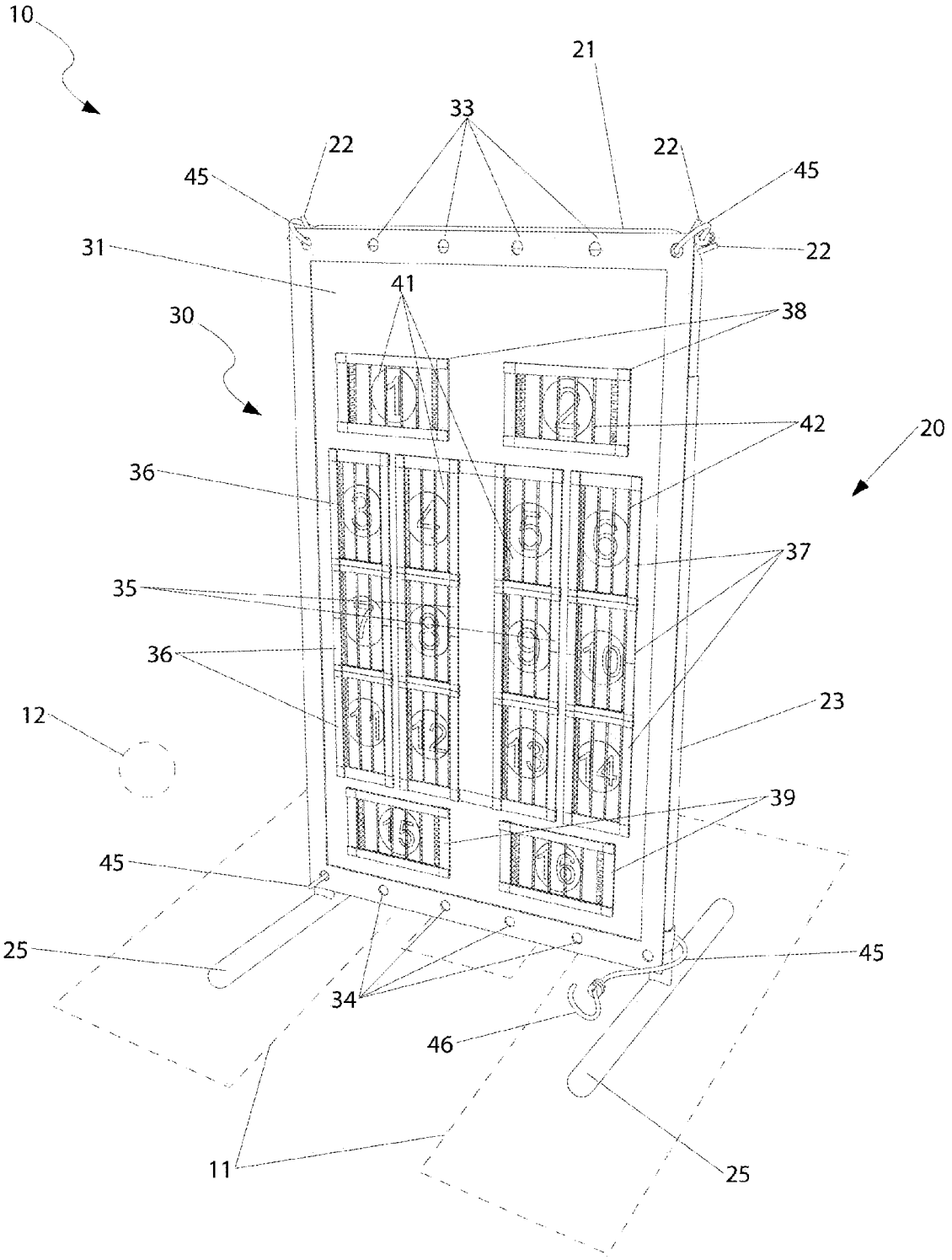
FIG. 1 is an environmental front view of a baseball pitching training apparatus, according to a preferred embodiment in accordance with the invention.
Figure 2:
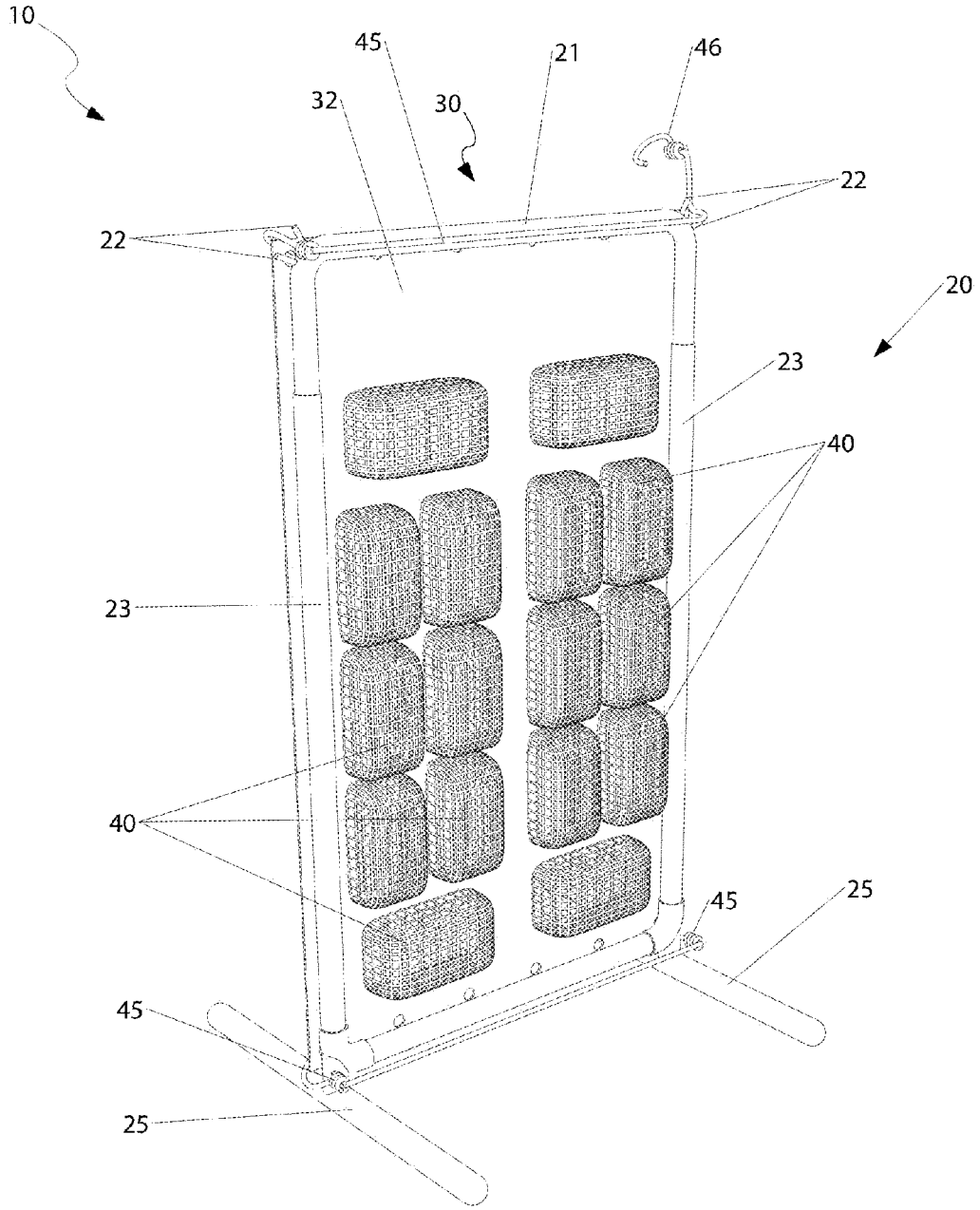
FIG. 2 is an environmental rear view of the baseball pitching training apparatus, according to the preferred embodiment.

FIG. 1 shows an environmental front view of the apparatus 10 and FIG. 2 shows an environmental rear view of the apparatus 10. The apparatus 10 is positionable within the boundaries of a batter's box 11, yet other locations can be utilized without limiting the scope or method of use of the apparatus 10.

The apparatus 10 generally includes a frame 20 which supports suspension of a target 30 that provides a target zones for a pitcher to aim. The target 30 includes up to sixteen (16) rectangular openings 42 which function as various pitching scenarios which are encountered when pitching to a batter. The frame 20 can be disassembled into a plurality of pieces for storage (see FIGS. 3 and 4). The frame 20 is preferably fabricated from sixteen (16) gauge metal tubing for strength and durability.

The target 30 measures approximately seventy (70) inches by forty-two (42) inches, yet it can be appreciated that other dimensions that correspond to varying skill levels can be utilized without limiting the scope of the apparatus 10. The target 30 is fabricated from a durable, flexible material such as, but not limited to: vinyl, canvas, or the like and is provided in various colors and patterns. An upper and lower perimeter edge of the target 30 has a plurality of target upper apertures 33 and a plurality of target lower apertures 34, respectively, which can be reinforced by inserted grommets.

The target upper apertures 33 secure the upper portion of the target 30 to an upper portion of the frame 20 by an elastic cord 45 and the target lower apertures 34 secure a lower portion of the target 30 to a lower portion of said frame 20 by another elastic cord 45. The elastic cords 45 are bungee-type cords which stretch to an expanded length that corresponds to the width of the frame 20 and suspends the target 30 tautly against the frame 20. It can be appreciated that other restraining or suspending devices can be utilized without limiting the scope of the apparatus 10, such as a plurality of elastic bands, clips, hooks, or similar fasteners. Each elastic cord 45 includes an end hook 46 at opposing ends which are insertingly attached within a selected upper or lower aperture 33, 34. While the plurality of upper and lower apertures 33, 34 are available, only a single pair of upper apertures 33 and a single pair of lower apertures 34 are utilized with each elastic cord 45. The target 30 can also be suspended from a batting cage or similar support structure in lieu of utilization of the frame 20. In this alternative support, the elastic cords 45 are wrapped through each respective upper and lower aperture 33, 34 and connected to the structure to suspend the target 30.

The openings 42 on the target 30 are situated in various target zones which simulate various positions for balls 12 to be aimed (also see FIG. 5). The center portion of a front target surface 31 includes a center zone 35 which generally forms the boundaries a ball 12 must pass in order to be considered a strike. The center zone 35 has up to three (3) rectangular openings 42 upon each longitudinal side, each measuring approximately three (3) to six (6) inches in width and eight (8) to ten (10) inches in length. A continuous border surrounds the perimeter of the center zone 35 to visually show the desired strike area. Offset approximately four (4) inches from the outer perimeter edges of each side of the center zone 35 is a left zone 36 and a right zone 37, respectively. Each outside zone 36, 37 provides a target for the pitcher to practice inside and outside pitches. The outside zones 36, 37 each have up to three (3) rectangular openings 42 for the ball 12 to pass through. Each outside zone 36, 37 measures approximately twenty-eight (28) inches in length by five (5) inches in width. The front target surface 31 also includes an upper zone 38 and lower zone 39 which provide a target for the pitcher to practice high or low pitches, respectively. The upper zone 38 and lower zone 39 each have a pair of rectangular openings 42 which measure approximately eleven (11) inches in width by five (5) inches in height.

FIG. 2 shows a plurality of mesh pockets 40 attached to a rear target surface 32. A single mesh pocket 40 is aligned with and matches a particularly zone 35, 36, 37, 38, 39 and holds a plurality of balls 12 after being thrown through the openings 42 of the particular zone 35, 36, 37, 38, 39. Each mesh pocket 40 is suitably sized to retain up to five (5) balls 12 and allows the pitcher to calculate the amount of intentional or intentional strikes thrown within a particular zone 35, 36, 37, 38, 39. Each mesh pocket 40 is durable enough to hold balls 12 thrown at high speeds and flexible enough for easy removal of the balls 12 from inside.

Figure 3:
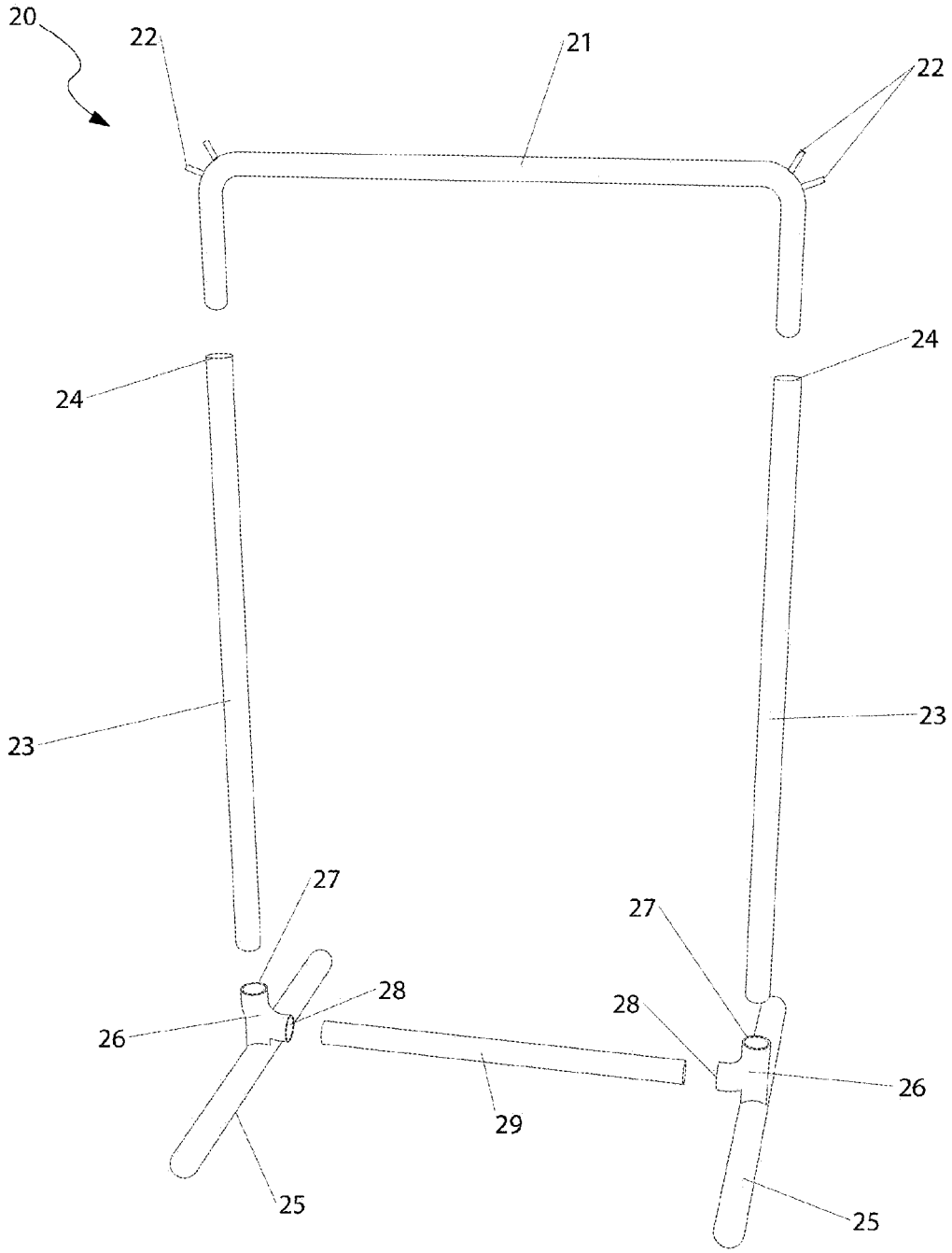
FIG. 3 is an exploded perspective view of a frame, according to the preferred embodiment.

FIG. 3 shows an exploded perspective view of the frame 20 and FIG. 4 shows a side view of the frame 20. The frame 20 provides an upright structure for supporting the target 30. The frame 20 includes a generally inverted "U"-shaped member 21, a pair of elongated vertical members 23, a pair of lower members 25, and a horizontal member 29. The tubular "U"-shaped member 21 is approximately forty-five (45) inches in width, seventeen (17) inches in length, and two (2) inches in diameter. The "U"-shaped member 21 includes a pair of guides 22 disposed upon each upper front surface.

The guides 22 are a pair of rigidly affixed, inverted "L"-shaped members which provide a guide for the elastic cord 45 to prevent the cord 45 from unintentionally being removed from the "U"-shaped member 21 while hooked to the target 30 when suspended from the frame 20. In use, the elastic cord 45 is wrapped around the rear side of the upper portion of the "U"-shaped member 21 (see FIG. 2) and attached at both ends to a selected pair of target upper aperture 33 on the target 30. Each end of the "U"-shaped member 21 is tapered to provide a friction fit when inserted into a vertical member aperture 24 disposed on each vertical member 23 upper end. The vertical members 23 measure approximately fifty (50) inches in length and are inserted into a "T"-portion upper aperture 27 disposed on each lower member 25. The lower end of each vertical member 23 is tapered to provide a friction fit when inserted into each respective "T"-portion upper aperture 27.

Each "T"-portion upper aperture 27 is integral to a "T"-portion 26 which is an extension of the lower member 25. The "T"-portion 26 measures approximately three-and-a-half (3½) inches in height. The "T"-portion 26 also includes a "T"-portion side aperture 28. The horizontal rod 29 has opposing tapered ends to provide a friction fit when inserted into each respective "T"-portion side aperture 28. The horizontal rod 29 joins and secures the frame 20 into a unitary member. Frontward and rearward extending portions of the lower member 25 measure approximately fifty (50) inches in length and contact a level surface, such as the standing surface of the batter's box 11. The lower members 25 also have a slightly upwardly inclined middle portion to assist in balancing the frame 20.

FIG. 5 shows a perspective view of the target 30. Each rectangular opening 42 of each zone 35, 36, 37, 38, 39 includes a plurality of integral entrance strips 41 that provide a pass-through surface for placement of various indicia which can designate individual openings 42 for coaching or instructional purposes. The indicia are preferably alphanumerical characters that correspond to and identify the zones 35, 36, 37, 38, 39. The entrance strips 41 are loose enough to allow balls 12 to pass through, yet strong enough to withstand impact from high speed, thrown balls 12.

FIG. 6 shows a perspective view of the alternate target 50, according to an alternate embodiment of the present invention. The alternate target 50 is also utilized for the pitcher to train throwing location and includes a sleeve 51 and a weighted rod 52. The alternate target 50 also includes the zones 35, 36, 37, 38, 39 and target upper apertures 33. However, in lieu of the target lower apertures 34, a sleeve 51 is sewn-into or otherwise provided along a bottom edge. The sleeve 51 is suited for insertion and support of a weighted rod 52 which weighs down the alternate target 50 tautly when suspended from a support structure. The sleeve 51 is integral to the material utilized for the alternate target 50 and the weighted rod 52 is preferably fabricated from heavy rubber and has a weight suitable to downwardly pull the alternate target 50. The alternate target 50 can be suspended by the frame 20 or batting cage or similar support structure.

It can be appreciated by one skilled in the art that other styles and configurations of the invention can be easily incorporated into the teachings of the present disclosure and only two particular configurations have be shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it is installed and utilized as indicated in FIGS. 1 through 5.

The method of installing the apparatus 10 can be achieved by performing a series of steps including, but not limited to, the following. Acquiring the apparatus 10 and interconnecting the "U"-shaped member 21 to the vertical members 23, interconnecting the vertical members 23 to the lower members 25, and interconnecting the horizontal member 29 to the lower members 25 to erect the frame 20. Positioning the frame 20 on a generally level surface. Suspending and attaching an upper portion of the target 30 from the frame 20 by routing a first elastic cord 45 against a rear upper surface of the frame 20 and through each guide 22 upon the "U"-shaped member 21 and attaching each end hook 46 to a selected pair of target upper apertures 33 on the front target surface 31. Securing a lower portion of the target 30 from the frame 20 by routing a second elastic cord 45 against a rear lower surface of the frame 20 and attaching each end hook 46 to a selected pair of target lower apertures 34 on the front target surface 31.

An alternate method of installing the apparatus 10 can be achieved by performing the following steps. Acquiring the apparatus 10. Suspending and supporting the upper portion of the target 30 from a native support structure by routing a first elastic cord 45 through each target upper aperture 33 and around the structure. Supporting the lower portion of the target 30 to the structure by routing a second elastic cord 45 through each target lower aperture 34 and around the structure.

The alternate embodiment of the present invention can be utilized by the user in a simple and effortless manner with little or no training. After initial purchase or acquisition of the alternate target 50, it can be installed as indicated in FIG. 6.

A method of installing the alternate target 50 can be achieved by performing a series of steps including, but not limited to, the following. Acquiring the alternate target 50 and interconnecting the "U"-shaped member 21 to the vertical members 23, interconnecting the vertical members 23 to the lower members 25, and interconnecting the horizontal member 29 to the lower members 25 to erect the frame 20. Positioning the frame 20 on the generally level surface. Suspending and attaching an upper portion of the target 30 from the frame 20 by routing a first elastic cord 45 against a rear upper surface of the frame 20 and through each guide 22 upon the "U"-shaped member 21 and attaching each end hook 46 to a selected pair of target upper apertures 33 on the front target surface 31. Positioning the weight rod 52 through the sleeve 51 to retain a lower portion of the alternate target 50 with a downward tension from the frame.

An alternate method of installing the alternate target 50 can be achieved by performing the following steps. Acquiring the alternate target 50. Suspending the upper portion of the alternate target 50 from a native support structure by routing a first elastic cord 45 through each target upper aperture 33 and around the structure. Positioning the weight rod 52 through the sleeve 51 to retain the lower portion of the alternate target 50 in a downward tension from the support structure.

The method of utilizing the apparatus 10 can be achieved by performing a series of steps including, but not limited to, the following steps. Selecting a particular target zone 35, 36, 37, 38, 39. Throwing a ball 12 at the selected zone 35, 36, 37, 38, 39. Collecting the thrown ball 12 in the mesh pocket 40 attached behind the selected zone 35, 36, 37, 38, 39. Retrieving the ball 12 as desired. The apparatus 10 can be disassembled as needed for storage and transport.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A baseball pitching training apparatus comprising:

a resilient flexible target comprising:

a plurality of target zone openings disposed through a front surface adapted to receive a pitched ball corresponding to a plurality of locations of said pitched ball;

a plurality of upper apertures along an upper edge;

a plurality of lower apertures along a lower edge; and, a plurality of mesh pockets affixed to a rear surface aligned with each of said plurality of target zone openings for retaining said pitched ball passing through any one of said plurality of target zone openings;

a plurality of entrance strips extending across each target zone opening of said plurality of target zone openings, said plurality of entrance strips of an associated target zone opening of said plurality of target zone openings being sufficiently spaced apart to allow said pitched ball to pass through said associated target zone opening and into an associated mesh pocket; and a rectangular frame for supporting said target in a substantially vertical plane.

2. The apparatus of claim 1, wherein said plurality of target zone openings further comprises a center zone corresponding to a strike zone, a right zone corresponding to a right outside of said strike zone, a left zone corresponding to a left outside of said strike zone, an upper zone corresponding to an upper outside of said strike zone, and a lower zone corresponding to a lower outside of said strike zone.

3. The apparatus of claim 1, wherein said frame further comprises:

an inverted "U"-shaped member having tapered ends;

a pair of elongated vertical members, each having an aperture on a top end for receivingly attaching one of said "U"-shaped member tapered ends and an opposing tapered bottom end;

a pair of lower members, each having a forward and a rearward extending member and a "T"-portion disposed at a middle portion between said forward and rearward extending members, said "T"-portion comprises an upper aperture for receivingly attaching said vertical member tapered bottom end and a side aperture;

a horizontal member having opposing tapered ends for insertingly attaching between opposing "T"-portion side apertures.

4. The apparatus of claim 3, further comprising:

a first elastic cord having end hooks disposed on opposing ends attachable around said inverted "U"-shaped member of said frame such that said first elastic cord end hooks connect to an opposing pair of said plurality of target upper apertures; and a second elastic cord having end hooks disposed on opposing ends attachable around said pair of lower members of said frame such that said second elastic cord end hooks connect to an opposing pair of said plurality of target lower apertures.

5. The apparatus of claim 3, wherein said "T"-portion of each of said pair of lower members is raised in relation to opposing ends of said forward and rearward extending members.

6. The apparatus of claim 4, wherein said frame further comprises a pair of guides affixed to opposing sides of said "U"-shaped member for maintaining said first elastic cord in a fixed position upon said frame.

7. The apparatus of claim 1, wherein said plurality of entrance strips of said associated target zone opening of said plurality of target zone openings comprises identifying indicia for individually identifying said associated target zone opening of said plurality of target zone openings.

8. The apparatus of claim 1, wherein said center zone further comprises up to three generally rectangular center zone openings disposed on a left vertical edge of said strike zone and up to three generally rectangular center zone openings disposed on a right vertical edge of said strike zone, further comprising a continuous border surrounding a perimeter of said center zone to visually identify a desired strike area.

9. The apparatus of claim 1, wherein said right zone further comprises up to three generally rectangular right zone openings disposed to a right outside of said right vertical edge of said strike zone.

10. The apparatus of claim 1, wherein said left zone further comprises up to three generally rectangular left zone openings disposed to a left outside of said left vertical edge of said strike zone.

11. The apparatus of claim 1, wherein said upper zone further comprises up to two generally rectangular upper zone openings disposed above said right vertical edge and said left vertical edge of said strike zone.

12. The apparatus of claim 1, wherein said lower zone further comprises up to two generally rectangular lower zone openings disposed below said right vertical edge and said left vertical edge of said strike zone.

13. The apparatus of claim 1, wherein said center zone further comprises up to three generally rectangular center zone openings disposed on a left vertical edge of said strike zone and up to three generally rectangular center zone openings disposed on a right vertical edge of said strike zone;

wherein said right zone further comprises up to three generally rectangular right zone openings disposed to a right outside of said right vertical edge of said strike zone;

wherein said left zone further comprises up to three generally rectangular left zone openings disposed to a left outside of said left vertical edge of said strike zone;

wherein said upper zone further comprises up to two generally rectangular upper zone openings disposed above said right vertical edge and said left vertical edge of said strike zone; and, wherein said lower zone further comprises up to two generally rectangular lower zone openings disposed below said right vertical edge and said left vertical edge of said strike zone.

* * * * *